United States Patent [19]

Rouzies

[11] Patent Number: 4,678,983

[45] Date of Patent: Jul. 7, 1987

[54] DC POWER SUPPLY WITH ADJUSTABLE OPERATING POINT

[75] Inventor: Christian Rouzies, Toulouse, France

[73] Assignee: Centre National d'Etudes Spatiales, Paris, France

[21] Appl. No.: 822,215

[22] Filed: Jan. 24, 1986

[30] Foreign Application Priority Data

Jan. 25, 1985 [FR] France ..... 85 01062

[51] Int. Cl.[4] ..... G05F 5/00

[52] U.S. Cl. ..... 323/222; 323/285; 323/299; 323/906

[58] Field of Search ..... 323/222, 282, 283, 284, 323/285, 299, 906

[56] References Cited

U.S. PATENT DOCUMENTS

| | | | |
|---|---|---|---|
| 3,566,143 | 2/1971 | Paine et al. | 323/906 X |
| 3,626,198 | 12/1971 | Boehringer | 323/222 X |
| 3,696,286 | 10/1972 | Ule | 323/222 X |
| 4,092,712 | 5/1978 | Harrigill, Jr. et al. | 323/906 X |
| 4,404,472 | 9/1983 | Steigerwald | 323/906 X |

FOREIGN PATENT DOCUMENTS

| | | | |
|---|---|---|---|
| 2903559 | 12/1980 | Fed. Rep. of Germany . | |
| 0089068 | 5/1983 | Japan | 323/906 |

OTHER PUBLICATIONS

O'Sullivan et al., "Developments in Modular Spacecraft Power Conditioning for Application Satellites", Proceedings of the 13th Intersociety Energy Conversion Engineering Conference, San Diego, CA, U.S.A., (Aug. 20–25, 1978), pp. 28–36.

*Primary Examiner*—Peter S. Wong

*Attorney, Agent, or Firm*—Fleit, Jacobson, Cohn & Price

[57] ABSTRACT

The invention relates to a DC power supply having an adjustable current/voltage (I/V) operating point. The power supply comprises a solar cell (1) and buffer battery (2) connected in parallel. It additionally comprises means connected in parallel with the solar cell for temporarily raising the output voltage in order to enable the operating point of the power supply to be changed. The invention is applicable to artificial satellites.

13 Claims, 5 Drawing Figures

DC POWER SUPPLY WITH ADJUSTABLE OPERATING POINT

The invention relates to a DC power supply with an adjustable operating point, the power supply being of the type comprising a solar cell and a buffer storage assembly connected in parallel, said storage assembly comprising a constant voltage element connected in series with a one-way conductor or diode.

BACKGROUND OF THE INVENTION

With this type of power supply, it is usually desirable to deliver electrical energy to the useful load CU of the power supply at a constant power level. Generally, the useful load consists of a load per se connected in series with a preregulator constituted by a "BUCK" or "BOOST" circuit. This type of circuit is essentially reactive and hardly consumes any power at all in normal operation. The characteristic curve of constant power consumption in the I-V plane, where I is the current fed to the useful load and V is the voltage supplied to the useful load, is hyperbolic in shape as shown by the dashed line in FIG. 1. The same graph also shows the current/voltage (I/V) curves for a solar cell 1 (continuous line), and for a buffer storage battery 2 plus diode D (dot-dashed lines), thereby enabling a composite characteristic curve to be defined (dotted line 1) for the assembly comprising the solar cell 1 and the buffer battery 2. The useful load may thus be fed at constant power at three operating points A, B, or C where the composite characteristic of the solar cell 1 and its battery 2 intersects the constant power hyperbola. Because of the nature of BUCK or BOOST circuits, and mainly because of the difference in absolute value between the slope of the composite characteristc (dots 1) and the constant power hyperbola, operating point B is inherently unstable. Any variation in voltage and/or current when the system is operating at point B has the effect of bringing the real operating point either to point A or else to point C along the constant power hyperbola. Points A and C are inherently stable with the sign of the difference between the hyperbola slope and the composite slope being opposite to the sign of the same difference at point B.

However, it is undesirable for the system to operate at $I_A$, $V_A$ since in this state the current supplied by the battery is greater than the current supplied by the solar cell, thereby regularly discharging the buffer battery. The solar cell is capable of supplying all of the power required only at operating point $I_C$, $V_C$.

Voltage regulators for regulating the voltage delivered by such systems may be used in order to mitigate the inevitable fluctuations or variations in the supply voltage due either to variations in the illumination of the solar cell or else to variations in the charge and/or internal resistance parameters causing variations or fluctuations in the corresponding operating point. Such regulators are described in the patent filed in Belgium under the No. 853 124 and in the name of the Organisation Européenne des Recherches Spatiales (i.e. the European Space Research Organization). These voltage regulators subdivide the solar cell into a plurality of elementary solar cells, thereby quantifying the power delivered to the load, and regulating said consumed power between two successive quantification levels. Although this type of device regulates to power satisfactorily, it does not allow the operating point of the system to be adjusted to one of the desired points, and overall it resembles a voltage limiter.

Preferred implementations of the present invention remedy the above drawbacks.

SUMMARY OF THE INVENTION

The present invention provides a DC power supply having an adjustable current/voltage (I/V) operating point, said power supply comprising a source of electrical energy of the current generator type connected in parallel with a buffer storage assembly comprising a constant voltage element connected in series with a one-way conductor, said power supply being intended to power a useful load assembly having a hyperbolic power consumption characteristic of the rectangular hyperbola type ($I=P/V$, where P is its power consumption), and said source of electrical energy having an output characteristic of current as a function of voltage I (V) having two points of intersection with said hyperbolic power consumption characteristic, said power supply including the improvement of voltage-raising means having an output connected in parallel with said useful load, and capable of temporarily raising the power supply voltage fed to said load.

The invention is applicable in space to power electronic circuits in artifical satellites and also in other installations where power consumption is substantially constant.

BRIEF DESCRIPTION OF THE DRAWINGS

Embodiments of the invention are described by way of example with reference to the accompanying drawings, in which.

MORE DETAILED DESCRIPTION

Figure 2:
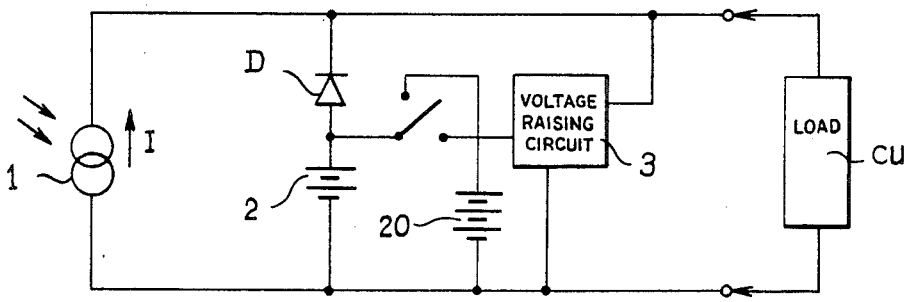
FIG. 2 is a block diagram of a power supply in accordance with the invention.

With reference to the block diagram of FIG. 2, a DC power supply in accordance with the invention comprises a buffer storage assembly constituted by a constant voltage element 2 connected in series with a one-way conductor D. The constant voltage element 2 is constituted, for example, by a buffer storage battery and the one-way conductor D is constituted, for example, by a diode. The above buffer storage assembly is connected in parallel with a source of electrical energy 1 of the current generator type having a characteristic curve I(V) with two points of intersection in nominal operation with the characteristic power consumption curve of a useful load assembly CU, which curve is of the rectangular hyperbola type $I=P/V$, where P is the power consumed. The term "current generator" is used to cover any DC generator capable of supplying a useful load CU with power on a characteristic which is substantially rectangular or which is rectangular in the I/V plane, i.e. a generator operating as a current generator in a first given voltage range and as a voltage generator in a second, adjacent voltage range. The term also covers any current generator associated with its storage assembly (as described above) and provided, in addition, with a voltage limiter, thereby defining a system which operates, substantially within said second voltage range, as a voltage generator, i.e. having a characteristic parallel to the current axis.

The solar cell may be constituted by a series of silicon cells capable of delivering electricity in the form of a direct voltage when exposed to solar radiation. The solar cell 1 and the buffer battery 2 are connected in parallel, for example, by means of a diode D (as shown in FIG. 2). In addition, the power supply includes temporary voltage-raising means 3 connected in parallel with the solar cell 1 and allowing the operating point of the power supply to the useful load CU to be adjusted to the desired point.

Figure 1:
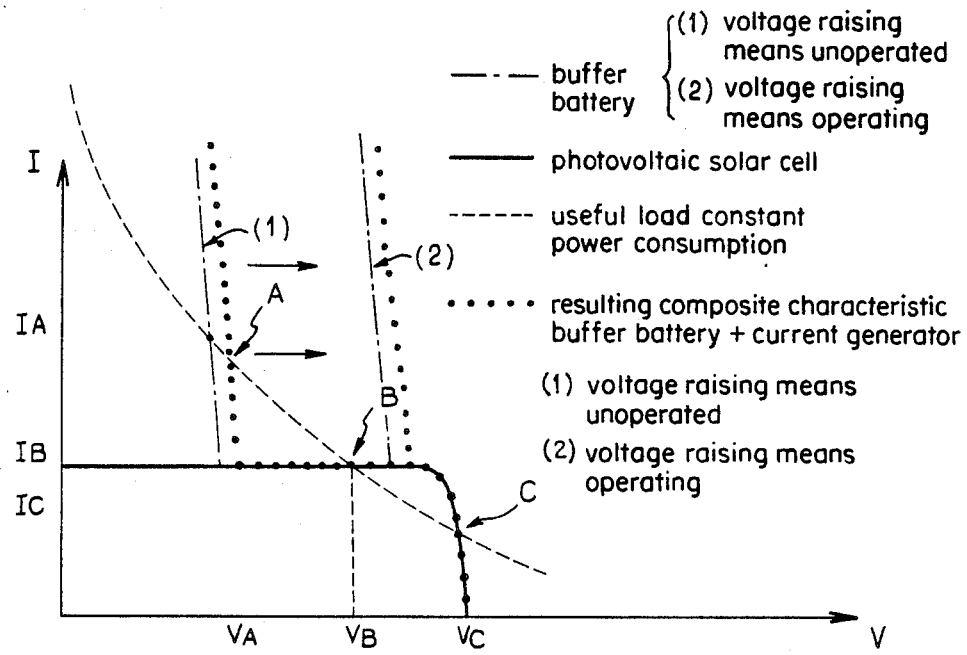
FIG. 1 is a graph showing a current/voltage (I/V) characteristic of a power supply in accordance with the invention.

With reference to FIG. 1, any unwanted latching of the operating point of the power supply to the useful load to point B and then to point A (where point A is undesirable for the reasons mentioned above) can only be returned to operating point C by the means 3 temporarily raising the voltage effectively applied to the useful load. It will be understood, that because of the instability of the operating region B-C on the power consumption hyperbola, that the amount by which the voltage must be raised to move the operating point from point A to point C must be greater than the value $V_B - V_A$. Furthermore, in order ensure that the above-mentioned voltage-raising means 3 operate normally, the instantaneous additional power supplied thereby to the useful load CU must be no less than:

$$P_3 = V_A \times (P_{CU}/V_A - I_B)$$

where $V_A$ is the system voltage applied to the useful load CU when the operating point is latched to stable point A, where $P_{CU}$ is the power consumed by the useful load CU, i.e. the power P which determines the equation of the rectangular hyperbola, and where $I_B$ is the current corresponding to the unstable operating point B. When the voltage-raising device 3 is not in operation, the two stable operating points are A and C, with the point B being unstable. Because the point C is stable, any system of this type which is caused to operate at point C latches to said operating point C under normal conditions of use. In the event that the power supply is not latched to operating point C, but rather to point A, the voltage-raising means 3 serve to apply a voltage (dot-dashed line 2 in FIG. 1) to the useful load CU, which voltage is greater than the battery voltage. As a result the battery is automatically disconnected by the diode D. The initial characteristic curve (1) thus temporarily becomes the resulting composite characteristic curve (2).

Provided the composite characteristic curve (2) has a voltage V greater than $V_B$ at current $I_B$, there is only one possible stable point of intersection $I_C$, $V_C$ with the constant power consumption hyperbola, and the operating point will latch to said stable point C even after the extra voltage has been removed. The power supply then continues to operate at point C even though operating conditions have returned to a state where there is another stable operating point, namely the point A.

Figure 3:
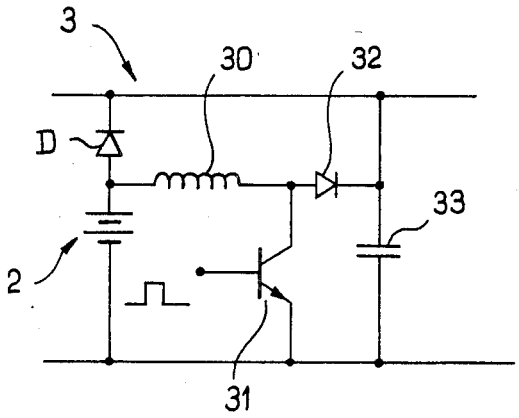
FIG. 3 is a circuit diagram of a portion of circuit used in the invention.

FIG. 3 is a circuit diagram showing one possible embodiment of the voltage-raising means 3. This embodiment comprises a reactor 30 connected in parallel with the buffer batttery 2 by means of a control switch 31. Naturally, the reactor 30 could also be connected to an auxiliary battery, as shown by battery 20 in FIG. 2 independent from the buffer battery 2, supposing that an auxiliary battery is available, in which case the voltage-raising means 3 become independent. the voltage of the auxiliary battery could be chose to be equal to 60 V or 70 V, for example. The point where the reactor 30 is connected to the switch 31 is additionally connected to the output from the power supply via a diode 32. Closing the switch 31 has the effect of charging the reactor 30 with reactive energy, and opening the switch 31 has the effect of releasing the reactive energy thus stored in the reactor 30 into the power supply output, thereby temporarily raising the voltage applied to the load, as desired. By way of example, the reactor 30 may be constituted by an inductor winding and the control switch 31 may be constituted by a common emitter connected transistor operating in ON/OFF mode. To this end, a voltage pulse of sufficient magnitude is applied to the base of the transistor 31 to ensure that it is either fully on or else fully off.

In order to improve the operation of the above-described temporary voltage-raising means, it is also possible to replace the single control pulse applied to the transistor 31, and consequently the single temporary pulse of increased voltage applied to the power supply output, by a succession of control pulses applied to the base of the transistor 31. The succession of pulses may be constituted by a train of rectangular pulses at a recurrence frequency of 10 kHz, for example. In this case, a smoothing capacitor 33 is additionally provided connected in parallel with the power supply output. This smoothing capacitor has the effect of integrating successive charges and discharges of the reactor 30 throughout the duration of the train of control pulses applied through the transistor 31. The average voltage developed in this way across the terminals of the capacitance A serves to provide a corresponding increase in the output voltage from the power supply up to the above-specified level throughout the duration of the train of pulses. The duty ration of the pulses (i.e. the ration between the condution time t divided by the total period T of the pulses is chosen to be greater than the ratio:

$$(V_{FD} - V_B)/V_{FD}$$

where $V_B$ is the voltage at the unstable operating point B, and where $V_{FD}$ is the voltage delivered by the buffer battery 2 at the end of a period of night or at the end of a period when the current generator 1 has not been operation, with the battery 2 being substantially discharged.

Figure 4:
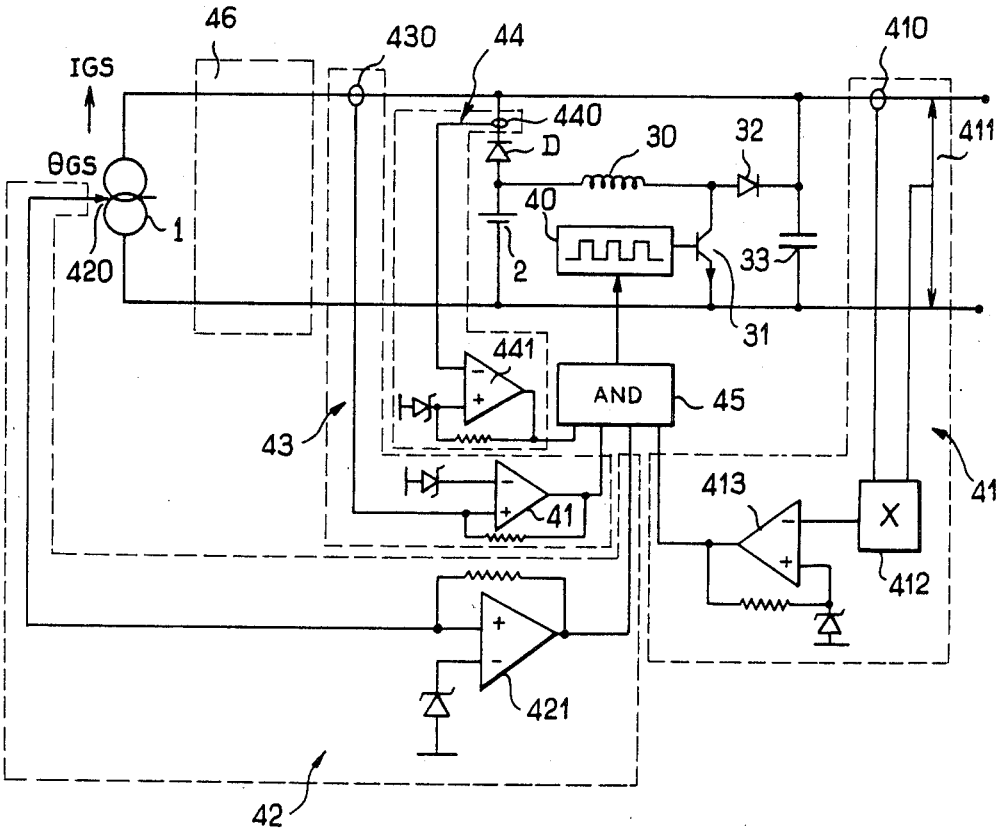
FIG. 4 is a circuit diagram of a power supply in accordance with the invention, and capable of operating automatically as a function of the main parameters of its environment.

A power supply which operates automatically as a function of the main parameters of its environment and the main power supply parameters is now described with reference to FIG. 4. In FIG. 4 the same references are used to designate the same items as already described with reference to the preceding figures. In addition, the recurrent pulses for controlling transistor 31 are delivered by an oscillator 40 controlled by control logic circuit on the basis of:

the instantaneous power consumed by the useful load CU;

the operating conditions of the current generator 1 as a function of temperature;

the detected day/night operating conditions of the current generator 1; and the operating conditions of the buffer battery used.

The control logic shown comprises a comparator chain 41 for comparing the instantaneous power consumed by the useful load CU with a reference power representng the maximum power that can be delivered by the solar cell 1. It further includes a comparator chain 42 for comparing the operating temperature of the solar cell 1 with a reference temperature corresponding to the solar cell operating under normal illumination. The control logic also includes a comparator chain 43 for detecting daytime operation of the solar cell relative to its nighttime state. Finally, there is a comparator chain 44 for comparing discharging conditions of the buffer battery 2 with non-discharging conditions, and a four-input AND gate 45 receiving the signals delivered by the respective comparator chains 41 to 44 and which delivers an enable signal to the control oscillator for controlling the transistor 31.

Thus, as can be seen in FIG. 4, the instantaneous power comparator chain 41 comprises current sensor means 410 for delivering a signal representative of the instantaneous current I drawn by the useful load CU. Means 411 for measuring the voltage V applied across the useful load CU also deliver a signal which is representative of said voltage V. Multiplier means 412 receive the signals delivered by the current sensor means 410 and by the voltage measuring means 411 and deliver a signal representative of the instantaneous power drawn by the useful load CU to the first input of threshold comparator means 413. The threshold comparator means 413 also receive a reference value on a second input which represents the maximum power that the solar cell 1 is capable of delivering, and the output from said threshold comparator means constitutes the output from the power comparator chain 41 and delivers a power condition signal.

Similarly, the operating temperature comparator chain 42 includes a detector 420 for detecing the effective operating temperature of the solar cell 1 and for delivering a signal representative of said temperature. A threshold comparator 421 receives the signal delivered by the temperature sensor 420 on a first input and receives a reference temperature value on a second input. The output from the comparator 421 constitutes the output from the temperature comparator chain and delivers a temperature condition signal.

The comparator chain 43 for detecting daytime/-nighttime operation comprises a current sensor 430 which delivers a signal representative of the instantaneous current $I_{GS}$ delivered by the solar cell 1. A threshold comparator 431 receives this signal on a first input and receives a reference value on a second input respresentitve of nighttime operation of the solar cell 1. The output from the comparator constitutes the output from the comparator chain 43 and delivers a signal daytime/nighttime condition signal.

The comparator chain 44 for comparing the discharging/not discharging state of the buffer battery comprises a current sensor 440 which delivers a signal representative of the current delivered by the buffer battery 2. A threshold comparator 441 receives said signal on a first input and has a second input connected to receive a reference signal representative of a specific charging/-not charging state of the buffer battery 2. The output from the comparator 441 constitutes the output from the comparator 44 and delivers a charging/discharging condition signal.

In FIG. 4, the current sensors 410, 430, and 440 may be constituted by respective small value resistances through which the current to be measured passes. In this case the voltage drops across said resistances are representative of said current, However, and preferably, the current sensors may be constituted by Hall effect sensors. Also, the sensor 440 could be replaced by measuring the forward or reverse voltage of the diode D. The multiplier circuit 412 may be constituted, for example, by any suitable commercially-available analog multiplier. The threshold comparators 413, 421, 431, and 441 are constituted by commercially-available differential amplifiers. The various references respectively applied to one of the terminals of each of said differential amplifiers may be obtained by means of respective zener diodes, for example, as shown in FIG. 4. However, for the comparator 441, the zener diode may be replaced by a connection to the input which corresponds to the reference voltage together with a feedback connection from the output of the comparator. In this case the discharging state of the buffer battery 2 is merely compared with its non-discharging state.

The automated power supply circuit in accordance with the invention and shown in FIG. 4 is particularly well suited to use in space for powering the electrical circuits of artificial satellites. In this case, and by virtue of the near impossibility of performing repairs in the event of breakdown, this type of automation makes it possible to tolerate operating defects due to particularly unfavorable operating conditions for the power supply, at least temporarily. For example, when the satellite and its onboard power supply is eclipsed, the operating temperature of the assembly is likely to fall to a very low value, e.g. less than −20° C., with the accompanying risk when the satellite returns to a zone of penumbra or when it returns to a fully illuminated zone of the current/voltage (I/V) characteristic of the solar cell changing very greatly in a manner which is dangerous for the asssembly. For example, the voltage effectively delivered by the solar cell may be very greatly increased while the current remains substantially unchanged, with the consequent grave risk of the satellite's electric circuits being damaged. In this case, the absence of an output signal from the comparator chain 42 by virtue of the corresponding drop in operating temperature has the effect of preventing the circuits in accordance with the invention from operating and thereby of protecting the circuits downstream from the power supply by latching the power supply to the stable operating point A.

The comparator chain 43 also makes it possible to automatically start up the circuit in accordance with the invention by means of the output signal relating to daytime/nighttime operation of the solar cell 1, since changing the operating point to coincide with the selected operating point is justified only when the solar cell is effectively operating under daytime conditions.

Finally, the comparator chain 41 serves to cause the operating point C to be selected only when the load is attempting to draw less power than the maximum power which can be provided by the solar cell 1.

Figure 5:
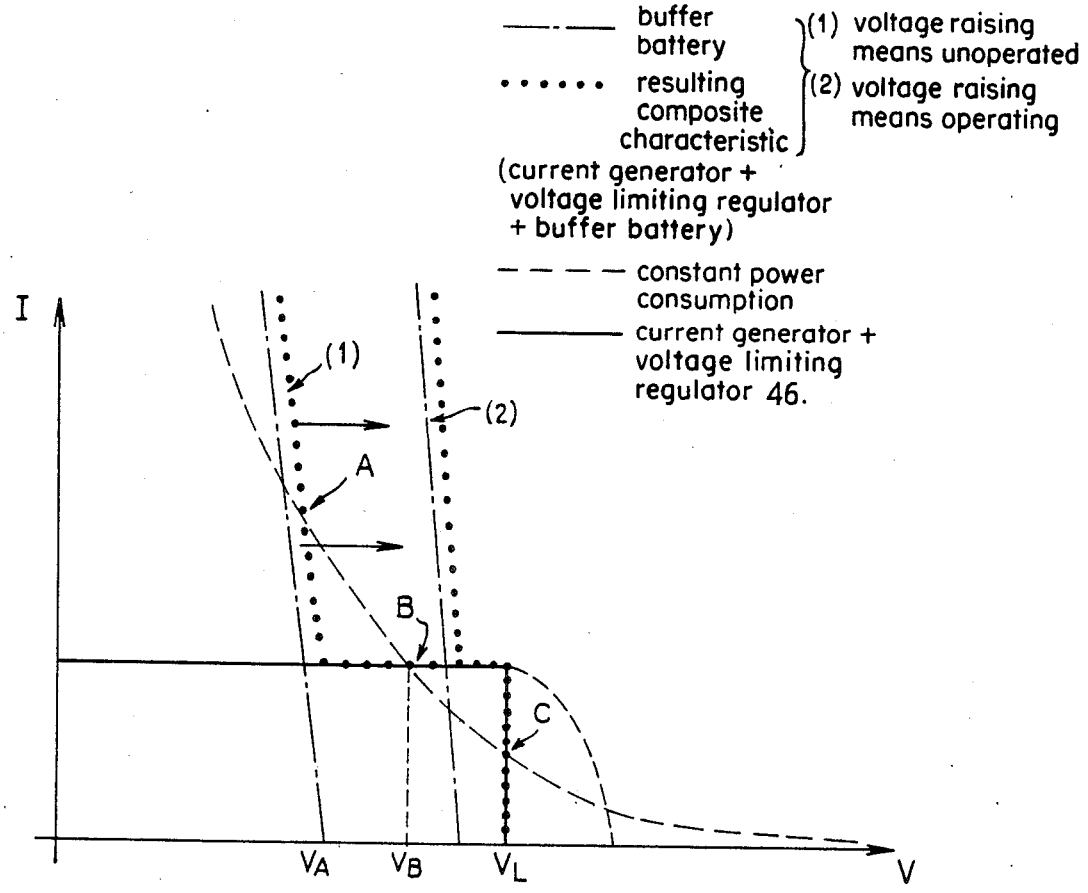
FIG. 5 is a graph showing the performance of a power supply in accordance with the invention when fitted, in addition, with a voltage limiter.

Operation of the circuit in accordance with the invention is now described by way of example and with reference to FIG. 5, in which the voltage generated by the solar cell 1 is, additionally, limited by means of a limiting system 46 such as that described in Belgian Pat. No.

853 124, for example. Other dissipating or non-dissipating conventional regulators could also be used. As can be seen in FIG. 5, when regulation takes place, its effect is to modify the static I(V) characteristic of the generator downstream from the voltage-limiting regulator. The resulting characteristic of the asssembly constituted by the solar cell and the regulator thus appears to be truncated at the limiting voltage $V_L$ during daytime operation. The circuit in accordance with the invention may continue to be used in accordance with the same operating principles, except that the selectable stable operating point is now located on the vertical line at voltage $V_L$. It may be observed that, in this case, the automated solution no longer requires a chain for monitoring the temperature of the solar generator. This is because the voltage provided downstream from the solar cell and regulator assembly is in any case limited regardless of temperature.

The above description relates to a DC power supply which is particularly suitable for independent operation under the particularly hostile operating conditions to be found, for example, onboard a space satellite. Naturally, this type of power supply may be used in other technical fields where electrical energy is provided by means of photocells. The automated embodiment may also be used in applications other than space applications, merely by suitable modification of some of the threshold values applied to the various comparators, and as a function of the intended application.

I claim:

1. A DC power supply having an adjustable current-/voltage (I/V) operating point comprising a source of electrical energy, of a current generator type connected in parallel with a buffer storage assembly comprising a constant voltage element connected in series with a one-way conductor said power supply being intended to power a useful load assembly having a hyperbolic power consumption characteristic of a rectangular hyperbola type ($I=P/V$, where P is its power consumption), and said source of electrical energy having an output characteristic of current as a function of voltage I(V) having two points of intersection with said hyperbolic power consumption characteristic, and voltage-raising means having an output connected in parallel with said useful load, and capable of temporarily raising the power supply voltage fed to said load.

2. A power supply according to claim 1, wherein said source of elecrtrical energy is constituted by a photovoltaic solar cell, and a voltage regulator being provided between the assembly constituted by the cell and the buffer storage and an intended load in order to limit the resulting voltage delivered by the power supply.

3. A power supply according to claim 1, wherein said voltage-raising means is constituted by a pulse generator circuit which has an independent power supply.

4. A power supply according to claim 1, wherein said voltage-raising means comprise a reactor powered by a battery via a control switch, said reactor and switch having a common terminal connected to the output from the power supply via a diode.

5. A power supply according to claim 4, wherein the battery feeding the reactor is said constant-voltage element and is constituted by a buffer battery.

6. A power supply according to claim 4, wherein the switch is a common emitter transistor circuit operating in ON/OFF mode.

7. A power supply according to claim 6, wherein the base of the transistor is controlled by a recurrent pulse train, and a smoothing capacitor is additionally provided, connected in parallel with the output from the power supply.

8. A power supply according to claim 7, wherein the recurrent transistor-controlling pulses are delivered by an oscillator which is itself conditionally controlled by control logic responding to the following conditions:

instantaneous power consumed by the useful load;

operating temperature conditions of the solar cell;

detected daytime/nighttime operating conditions of the solar cell; and operating conditions of the constant voltage element

9. A power supply according to claim 8, wherein said control logic comprises:

a comparator chain for comparing the instantaneous power consumed by the useful load with a reference power representative of the maximum power capable of being delivered by the solar cell;

a comparator chain for comparing the operating temperature of the solar cell with a reference temperature representative of the solar cell operating under normal illumination;

a comparator chain for comparing the detection of daytime/nighttime operation of the solar cell relative to its nighttime condition;

a comparator chain for comparing buffer battery discharging operating conditions with buffer battery charging operation conditions; and an AND gate havig four inputs each receiving a respective one of the signals delivered by said comparator chains and delivering an enable signal to the transistor-controlling oscillator.

10. A power supply according to claim 9, wherein said chain for comparing the instantaneous power comprises:

current sensing means delivering a signal representative of the instantaneous current drawn by the useful load;

voltage measureing means for measuring the voltage applied to the useful load, said means delivering a signal representative of said voltage;

multiplier means receiving the signals delivered by said current sensor means and said voltage sensor means and delivering a signal representative of the instantaneous power consumed by the useful load; and threshold comparator means receiving said signal delivered by said multiplier means on a first input and having a second input connected to receive a reference value, said reference value representing the maximum power threshold capable of being delivered by the solar cell, said comparator means delivering a power condition output signal and constituting the output from said power comparator chain.

11. A power supply according to claim 9, wherein said comparator chain for comparing the operating temperature of the solar cell comprises:

a temperature sensor for detecting the effective operating temperature of the solar cell and for delivering a signal representative of said temperature; and a threshold comparator receiving said signal delivered by said temperature sensor on a first input and having a second input connected to receive a reference temperature value, said comparator delivering an output temperature condition signal and constituting the output from said temperature comparison chain.

12. A power supply according to claim 9, wherein said comparator chain for detecing daytime/nighttime operation of the solar cell comprises:

a current sensor delivering a signal representative of the instantaneous current delivered by the solar cell; and a threshold comparator receiving said signal delivered by said current sensor on a first input and having a second input connected to receive a reference value corresponding to nighttime operation of the solar cell, said comparator delivering an output daytime/nighttime condition signal and constituting the output signal from said daytime/nighttime comparator chain.

13. A power supply according to claim 9, wherein said comparator chain for distinguishing the discharging/charging states of the buffer battery comprises:

a current sensor delivering a signal representative of the current delivered by the buffer battery; and a threshold comparator receiving said signal delivered by said current sensor on a first input and having a second input connected to receive a current reference value corresponding to the battery being charged, said comparator delivering an output battery discharging/charging condition signal and constituting the output signal from said discharging/charging comparator chain.

* * * * *